US008256256B2

(12) United States Patent
Jesche et al.

(10) Patent No.: US 8,256,256 B2
(45) Date of Patent: Sep. 4, 2012

(54) COILING FURNACE

(75) Inventors: Micheal Jesche, Mödling (AT); Wolfgang Peitl, St. Florian (AT)

(73) Assignee: Siemens Vai Metals Technologies GmbH (AT)

( * ) Notice: Subject to any disclaimer, the term of this patent is extended or adjusted under 35 U.S.C. 154(b) by 494 days.

(21) Appl. No.: 12/443,738

(22) PCT Filed: Sep. 6, 2007

(86) PCT No.: PCT/EP2007/007774

§ 371 (c)(1),
(2), (4) Date: Mar. 31, 2009

(87) PCT Pub. No.: WO2008/040431

PCT Pub. Date: Apr. 10, 2008

(65) Prior Publication Data

US 2009/0320544 A1 Dec. 31, 2009

(30) Foreign Application Priority Data

Oct. 2, 2006 (AT) ..... A 1639/2006

(51) Int. Cl.
*B21K 29/00* (2006.01)

(52) U.S. Cl. ..... 72/146; 72/148; 72/202

(58) Field of Classification Search ..... 72/146, 72/148, 200, 202, 229, 250, 8.8, 10.3, 11.5, 72/12.5

See application file for complete search history.

(56) References Cited

U.S. PATENT DOCUMENTS 848,543 A 3/1907 Fish (Continued)

FOREIGN PATENT DOCUMENTS

EP 0 168 375 A1 1/1986

(Continued)

OTHER PUBLICATIONS

International Search Report dated Nov. 19, 2007, issued in corresponding international application No. PCT/EP2007/007774.

*Primary Examiner* — Edward Tolan
*Assistant Examiner* — Lawrence J Averick
(74) *Attorney, Agent, or Firm* — Ostrolenk Faber LLP

(57) ABSTRACT

A coiler furnace having a heat-insulated enclosure delimiting a furnace interior, a strip coiling device includes a coiler drum having a slotted receiving opening for the hot-rolled strip in the furnace interior, A controlled rotational drive for a coiler shaft is located outside the furnace interior. An inlet and outlet opening to the enclosure for a hot-rolled strip. A strip guiding device between a roller table and the coiler drum. In order to avoid any winding errors, a feeding shield extends through the enclosure of the coiler furnace and is coupled to a displacement drive arranged outside the furnace interior. The displacement drive can be displaced between an insertion position and a withdrawal position of the shield. The feeding shield, in the insertion position, interacts with the strip guiding device to form a feed funnel, mounted upstream the slotted receiving opening on the coiler drum for the hot-rolled strip together.

14 Claims, 3 Drawing Sheets

U.S. PATENT DOCUMENTS

| | | | | | |
|---|---|---|---|---|---|
| 2,628,790 | A | * | 2/1953 | Schmidt et al. | 72/137 |
| 2,646,231 | A | * | 7/1953 | Frielinghaus | 72/148 |
| 2,687,878 | A | * | 8/1954 | Montgomery | 242/532.6 |
| 3,553,992 | A | * | 1/1971 | Harbaugh | 72/8.4 |
| 3,613,426 | A | * | 10/1971 | Adair et al. | 72/202 |
| 4,442,690 | A | | 4/1984 | Hirschmanner et al. | 72/128 |
| 4,455,848 | A | | 6/1984 | Tippins et al. | |
| 4,485,651 | A | * | 12/1984 | Tippins et al. | 72/11.5 |
| 4,530,224 | A | * | 7/1985 | Hild et al. | 72/14.5 |
| 4,608,014 | A | | 8/1986 | Buchegger et al. | |
| 4,998,427 | A | * | 3/1991 | Peterson et al. | 72/8.6 |
| 5,131,134 | A | * | 7/1992 | Quambusch et al. | 29/527.7 |
| 5,269,166 | A | | 12/1993 | Thomas | |
| 5,479,807 | A | * | 1/1996 | Moser | 72/202 |
| 5,499,523 | A | * | 3/1996 | Ginzburg | 72/203 |
| 5,637,249 | A | * | 6/1997 | Smith | 219/619 |
| 5,771,732 | A | * | 6/1998 | Kramer et al. | 72/202 |
| 5,967,448 | A | * | 10/1999 | Berry et al. | 242/531.1 |
| 6,039,283 | A | | 3/2000 | Munoz-Baca et al. | |
| 6,089,067 | A | | 7/2000 | Yoshioka et al. | |
| 2004/0261484 | A1 | | 12/2004 | Dommel et al. | |
| 2006/0201222 | A1 | * | 9/2006 | Arvedi | 72/202 |

FOREIGN PATENT DOCUMENTS

| | | | |
|---|---|---|---|
| EP | 0 619 377 | A1 | 12/1994 |
| EP | 0 936 276 | A2 | 8/1999 |
| EP | 0 958 867 | | 11/1999 |
| JP | 10-034235 | A | 2/1998 |
| RU | 2 055 667 | | 3/1996 |
| RU | 2 101 112 | | 1/1998 |
| WO | WO 03/048397 | | 6/2003 |

* cited by examiner

COILING FURNACE

CROSS REFERENCE TO RELATED APPLICATION

The present application is a 35 U.S.C. §§371 national phase conversion of CT/EP2007/007774, filed Sep. 6, 2007, which claims priority of Austrian Application No. A 1639/2006, filed Oct. 2, 2006, the disclosure of which is incorporated by reference herein. The PCT International Application was published in the German language.

BACKGROUND OF THE INVENTION

The invention relates to a coiling furnace with a heat-insulated enclosure, which delimits a furnace interior. It concerns a strip coiling device, which comprises a coiling drum with a slit-shaped receiving opening for the hot-rolled strip in the furnace interior. A controlled rotary drive is arranged outside the furnace interior, for driving a coiling shaft. There is an entry and exit opening for a hot-rolled strip and a strip deflecting device between a roller table and the coiling drum.

Coiling furnaces are used in hot-rolling mills for buffer-storing a windable prestrip or hot-rolled strip between two rolling operations. Preferred application areas are reversing rolling mills or Steckel mills, in which at least one coiling furnace for winding up and unwinding a rolled stock kept at hot-rolling temperature are arranged on both sides of a rolling stand or a number of interacting rolling stands.

A coiling furnace of the type described at the beginning is already known, for example, from U.S. Pat. No. 5,269,166 A. A hot-rolled strip passed in a reversing manner through a rolling stand is led after each rolling pass over a roller table and over deflector flaps, which can be pivoted into the roller table, into the furnace interior of a coiling furnace and fed by a further flap to a slit-shaped receiving opening in the coiling drum. When it enters the receiving opening, the strip coiling device is set in rotation and the running-in hot-rolled strip is wound into a coil. There are isolated instances in which the head of the strip rises up (turn-up), and therefore no longer rests on the run-in guides and misses the receiving opening in the coiling drum. This misalignment of the running-in strip leads to entanglements in the furnace interior and to an interruption in the rolling and winding operation, and causes considerable difficulties in the removal of the hot-rolled strip from the furnace interior.

Such problems with the running-in hot-rolled strip can also occur, however, in the case of a coiling furnace according to EP 619 377 A1. The transporting path for the running-in hot-rolled strip is established by a number of pivoting flaps, which form a strip deflecting device. With a displaceable coiling drum, which, during the winding operation, is displaced transversely in relation to its axis of rotation in dependence on the constantly increasing coil diameter, the transporting path for the running-in strip is kept constant. A strip run-off guide, which can be actuated by a pressure-medium cylinder, is set against the coil at the beginning of the delivery operation, whereby the head of the hot-rolled strip is forced onto the transporting path formed by pivoting flaps. The detachment of the head of the strip from the coil and the transfer onto the pivoting flaps are thereby ensured and the possibility of detachment of the head of the strip elsewhere within the coiling furnace is ruled out. At the same time, the strip run-off guide can be used as a device for catching scale.

SUMMARY OF THE INVENTION

The object of the present invention is therefore to avoid these disadvantages and difficulties of the known prior art and to propose a coiling furnace of the type described at the beginning with which winding errors in rolling operation can be avoided to the greatest extent.

This object is achieved for a coiling furnace of the type described at the beginning by passing a feeding shield through the enclosure of the coiling furnace. The feeding shield is coupled to a displacement drive arranged outside the furnace interior so that the feeding shield can be displaced between a threading position and a withdrawal position. In the threading position, the feeding shield forming with the strip deflecting device a feeding funnel for the hot-rolled strip, and the funnel is arranged ahead of the slit-shaped receiving opening on the coiling drum.

During the threading operation, the coiling drum itself is located in an angular position in which the slit-shaped receiving opening is directed toward the running-in strip. The feeding shield can be brought into a threading position right in front of the winding surface of the coiling drum, for example into a threading position which is only a few millimeters, preferably 8-12 mm, in particular about 10 mm, in front of the winding surface, so that even a bent-up beginning of the strip can be reliably threaded into the slit-shaped receiving opening. This is ensured in particular by the feeding shield in the threading position being positioned at a distance from the winding surface of the coiling drum and directly next to the receiving opening, a longitudinal edge of the slit-shaped receiving opening preferably being covered by the feeding shield, as seen in the strip running-in direction, in order to avoid catching or bumping of the head of the strip.

The exact positioning of the feeding shield in relation to the receiving opening in the coiling drum allows the slit-shaped receiving opening to be installed much closer to the coiling drum than was previously possible. The slit-shaped receiving opening on the coiling drum preferably has a slit width which is less than four times the maximum thickness of the hot-rolled strip to be wound. In any case, the slit-shaped receiving opening on the coiling drum has a slit width less than or equal to 80 mm.

The feeding funnel formed by the strip deflecting device and the feeding shield expediently has an opening angle of between 10° and 50°, preferably between 10° and 30°. With this opening angle, it is ensured that no strip build-up occurs in the feeding funnel.

Immediately after the head of the strip enters the feeding slit of the coiling drum, the coiling shaft is set in a rotational movement, directed counter to the running-in movement of the hot-rolled strip, and winds up the running-in hot-rolled strip on the winding surface of the coiling drum. At the same time, the feeding shield must be moved at high speed away from its threading position in order not to hinder the winding operation. The feeding shield in the withdrawal position is preferably positioned outside a maximum coil diameter and closes its through-opening in the enclosure of the coiling furnace.

The high strip running speed of the running-in hot-rolled strip causes the coil diameter to increase very quickly, in particular in the first phase of the winding operation. To reliably ensure the fast withdrawing movement of the feeding shield that is necessary as a result, the displacement drive of the feeding shield comprises a pressure-medium cylinder and a transmission mechanism with a minimum transmission ratio of up to 10:1. To protect against heat exposure, the displacement drive is located on a console on the outer wall of the furnace enclosure.

A structurally simple embodiment of the displacement drive is achieved if the transmission mechanism with the necessary minimum transmission ratio is formed by a lever system, for example by a two-armed lever.

For trouble-free initiation of the winding operation in the coiling furnace, synchronized commencement of the coiling rotation and the withdrawal movement of the feeding shield is necessary. This is achieved by a roller table for the transport of the hot-rolled strip and measuring devices for recording times relating to the head of the strip and the transporting speed of the hot-rolled strip being arranged ahead of the coiling furnace, by these measuring devices being assigned a master control device, which determines the time of entry of the head of the strip into the receiving opening of the coiling drum, and by this master control device being connected to a rotary drive of the coiling shaft and the displacement drive of the feeding shield to initiate the winding operation and the commencement of the displacement movement of the feeding shield from the threading position into the withdrawal position.

The start of the winding operation and the start of the withdrawal movement preferably take place simultaneously or within a narrow time interval of 0.2 s.

Further advantages and features of the present invention emerge from the following description of non-restrictive exemplary embodiments, reference being made to the accompanying figures, in which:

DESCRIPTION OF A PREFERRED EMBODIMENT

Figure 3:
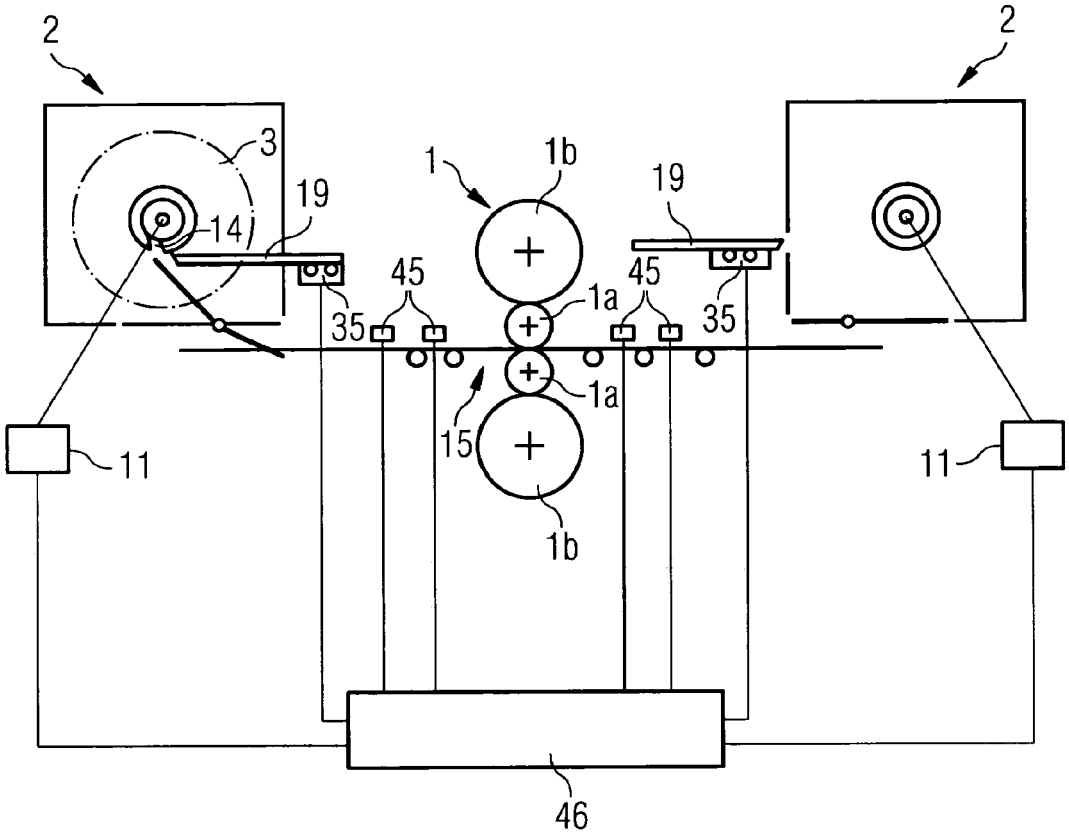
FIG. 3 shows a schematic representation of a reversing rolling mill with the control devices for positioning the feeding shield according to the invention.

FIG. 3 shows the overall representation of a reversing rolling mill for rolling a windable hot-rolled strip in a longitudinal section. The reversing rolling plant comprises a reversing rolling stand 1, which is formed as a four-high stand with working rolls 1*a* and supporting rolls 1*b*, and coiling furnaces 2 arranged on both sides of the reversing rolling stand for the alternating winding-up and unwinding of the hot-rolled strip running through the rolling stand in a changing rolling direction. The hot-rolled strip is indicated in the coiling furnace on the left as a rolled coil 3. The coiling furnaces 2 arranged ahead of and after the reversing rolling stand 1 are formed mirror-invertedly in relation to the rolling plane.

Figure 1:
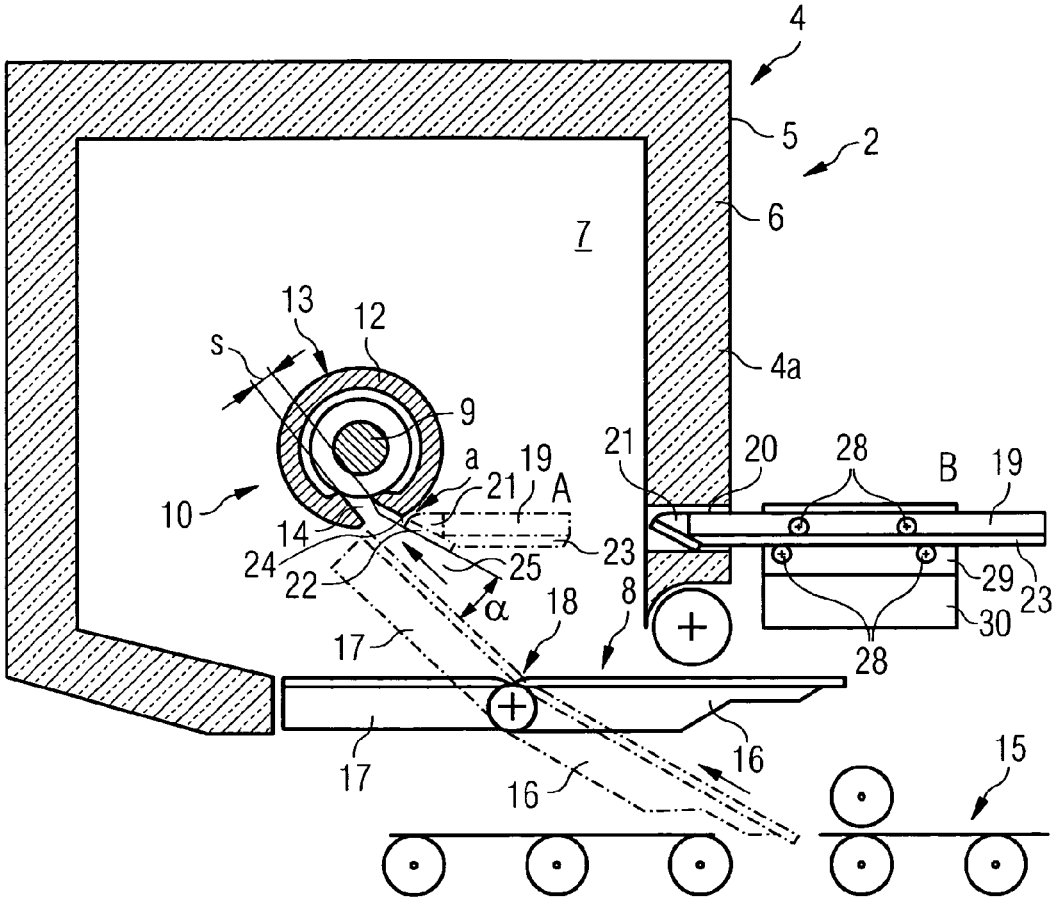
FIG. 1 shows a cross section through a coiling furnace according to the invention in a schematic representation.

FIG. 1 shows a coiling furnace 2 in a cross section. The coiling furnace comprises an enclosure 4, with a metallic outer wall 5 and a heat insulation 6, which is provided on the inside and delimits a furnace interior 7. In the bottom region of the coiling furnace there is a closable entry and exit opening 8 for the hot-rolled strip, directed toward the reversing rolling stand. This entry and exit opening 8 is closed by feeding flaps 16, 17 during the heating-up phase of the coiling furnace and during breaks in operation. The adjustment of the feeding flaps usually takes place with a hydraulic adjusting drive (not represented here), such as a pressure-medium cylinder. The coiling shaft 9 of a strip coiling device 10 passes through the front and rear walls of the enclosure 4 and is rotatably supported outside the coiling furnace in supporting bearings (not represented any more specifically) and connected to a rotary drive 11 (FIG. 3). The coiling drum 12, arranged in a rotationally fixed manner on the coiling shaft 9, has in the region of its winding surface 13 a slit-shaped receiving opening 14 for the running-in hot-rolled strip, which, coming from the rolling stand, is passed on a roller table 15 and by means of pivotable feeding flaps 16, 17 (represented by dashed lines) into the furnace interior 7 to the coiling drum 12, where it is wound up into a coil 3. During the threading and unthreading operations of the hot-rolled strip, one feeding flap 16 is pivoted into the roller table 15 and the second feeding flap 17 is directed toward the slit-shaped receiving opening 14 in the coiling drum. The feeding flaps 16, 17 form a strip deflecting device 18 and thereby determine the transporting path for the hot-rolled strip from the roller table 15 to the slit-shaped receiving opening 14 in the coiling drum.

The feeding shield 19 passes through the side wall 4*a* of the enclosure 4 in the through-opening 20 and is displaceable between a threading position A and a withdrawal position B. The feeding shield 19 comprises a head part 21 with a guide plate 22 and a guide rail 23, in which the head part 21 is releasably fixed at its end face. The guide rail 23 of the feeding shield 19 is supported and guided in a longitudinally displaceable manner outside the coiling furnace on a number of guide rollers 28, the guide rollers 28 being rotatably mounted in a guide housing 29 on a console 30.

In the threading position A (represented by dashed lines), the feeding shield 19 is located with its forwardmost end at a smallest possible distance a from the winding surface 13 of the coiling drum 12 and is positioned directly next to the receiving opening 14. Projection of the feeding shield 19 over the edge 24 of the opening, seen in the running-in direction of the hot-rolled strip indicated by an arrow, entirely rules out the possibility of the running-in hot-rolled strip becoming caught. The strip deflecting device 18 and the feeding shield 19 form, on the one hand by the guide flap 17 and on the other hand by the guide plate 21, a feeding funnel 25 for the running-in hot-rolled strip. The opening angle $\alpha$ of the feeding funnel is about 20°. The slit width s in the slit-shaped receiving opening 14 is below 80 mm.

In the withdrawal position B, the feeding shield 19 closes with its head part 21 the through-opening 20 in the side wall 4*a* and is consequently located in a position outside the maximum coil diameter and in a region of the coiling furnace that is relatively protected, including with respect to thermal loading.

Figure 2:
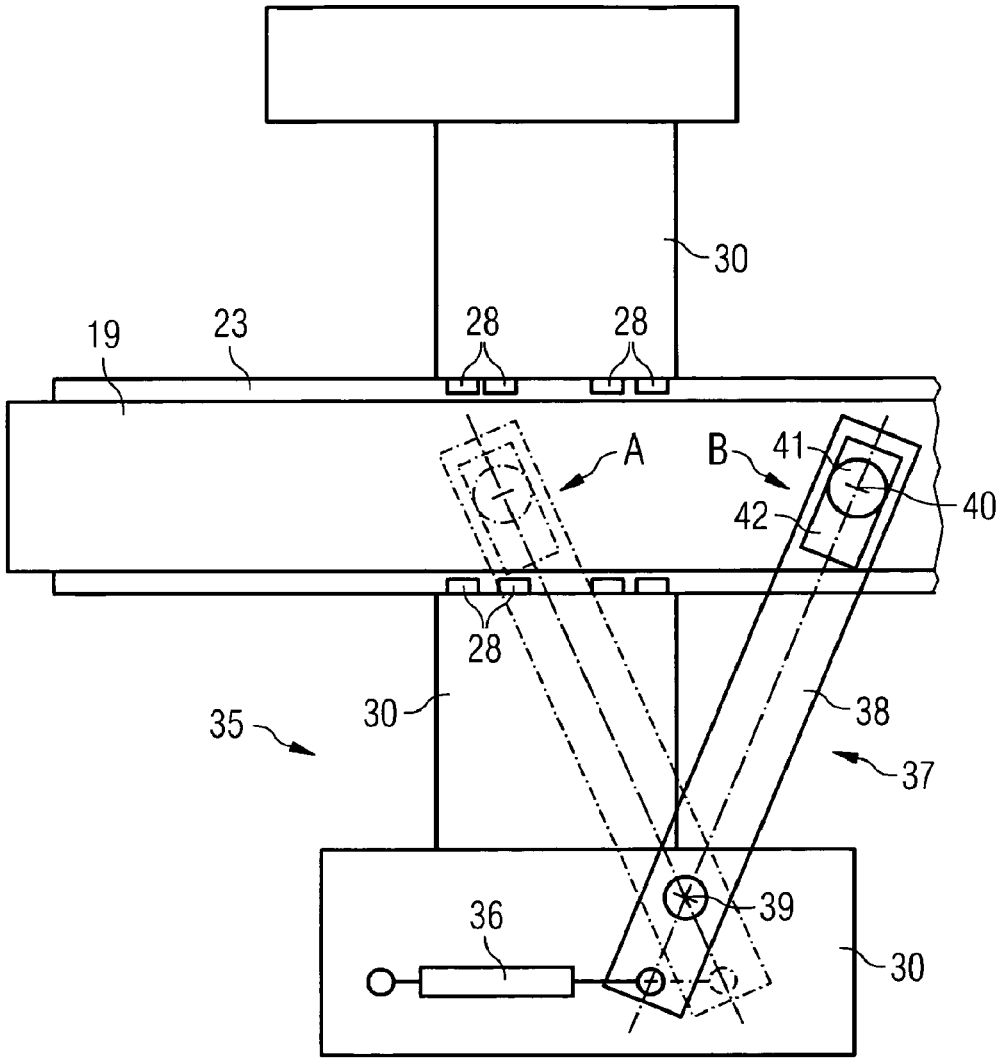
FIG. 2 shows a possible embodiment of a displacement drive for the feeding shield according to the invention in a plan view.

The withdrawal movement of the feeding shield 19 from the threading position A to the withdrawal position B is particularly time-critical and must therefore take place very quickly. Immediately the running-in hot-rolled strip enters the slit-shaped entry opening 14 of the coiling drum, the latter is set in rotation counter to the running-in direction of a hot-rolled strip and the hot-rolled strip is wound up into a coil. This causes tensioning of the running-in hot-rolled strip between the coiling drum and a pair of driving rollers on the rolling table. Only a few tenths of a second are available to avoid a collision with the rapidly growing coil or the suddenly tensioned hot-rolled strip. One possible embodiment of the displacement drive 35 necessary for a fast withdrawing movement from the threading position A into the withdrawal position B is schematically represented in FIG. 2 in a plan view. The displacement drive 35 comprises a pressure-medium cylinder 36 and a transmission mechanism 37. The feeding shield 19 is guided with its guide rail 23 on a number of guide rollers 28 and supported on the console 30. The transmission mechanism is formed as a two-armed lever 38, which is connected on the one hand to the feeding shield 19 and on the other hand to the pressure-medium cylinder 36. At a pivot pin 39, the two-armed lever 38 is likewise supported on the console 30. Mounted on the guide rail 23 is a slotted link 41, which is rotatable about the vertical axis 40 and is guided in a slot-shaped clearance 42 in the longer arm of the two-armed lever. The pressure-medium cylinder 36 supported on the console 30 is pivotably articulated on the shorter lever of the two-armed lever. This achieves the transmission of the realizable displacement speed of the system in the pressure medium cylinder necessary for a fast withdrawing movement, of up to 10:1.

The configuration of the displacement drive is not restricted to the embodiment presented. Rather, it is within the scope of the invention to provide other transmission mechanisms or drive means that ensure an adequately fast withdrawing movement, such as electromechanical or hydraulic adjusting and pivoting drives, which are distinguished by a high reaction speed and high withdrawing speed.

The measuring and control equipment necessary for the implementation of a fast withdrawing movement of the feeding shield is symbolically represented in FIG. 3 on the basis of the example of a reversing rolling mill with coiling furnaces arranged ahead of the rolling stand on both sides. Between the rolling stand 1 and the coiling furnace 2, measuring devices 45 for recording times relevant to the head of the strip (beginning of the strip) running to the respective coiling furnace are arranged in the region of the roller table 15. Two measuring devices 45 arranged at a certain distance one behind the other allow the determination of the transporting speed of the hot-rolled strip in a master control device 46 comprising a computer, to which the measuring signals of the measuring devices 45 are fed. From these input signals, the time of entry of the head of the strip into the receiving opening 14 of the coiling drum is calculated and starting pulses for the rotary movement of the strip coiling device 10 and the withdrawing movement of the feeding shield 19 are generated in the master control device. With these starting pulses, the respective rotary drive 11 of the strip coiling device 10 and the pressure-medium cylinder of the displacement drive 35 of the feeding shield 19 is actuated by in each case one of the two coiling furnaces 2.

The invention claimed is:

1. A coiling furnace configured to provide heat to a hot-rolled metal strip with a strip lead, the coiling furnace comprising:

a heat-insulated enclosure configured to delimit a furnace interior;

an entry and exit opening in the enclosure for the hot-rolled metal strip;

a metal strip coiling device comprising a coiling drum positioned in the furnace interior, a slit-shaped receiving opening in the drum for the hot-rolled strip, a controlled rotary drive operable for rotating the coiling drum so that the coiling drum performs a winding operation, the coiling drum including a winding surface configured to receive the hot-rolled metal strip;

a table operable for transport of the rolled-strip;

a strip deflecting device positioned between the table and the coiling drum;

a passage positioned through the enclosure of the coiling furnace and configured to receive therethrough a feeding shield;

the feeding shield configured to be passed through the passage;

a displacement drive coupled to the feeding shield, and the displacement drive is operable to displace the feeding shield between a strip threading position and a withdrawal position, such that in the threading position, the feeding shield is passed through the passage so as to form with the strip deflecting device a feeding funnel for conducting the strip lead of the hot-rolled strip to the coiling drum, and the funnel is arranged ahead of the slit-shaped receiving opening on the coiling drum;

a measuring device operable for recording times relating to the head of the strip and determining the transporting speed of the hot-rolled strip;

the table and the measuring device are arranged ahead of the coiling furnace;

a master control device for the measuring device, the control device being operable to determine a time of entry of the head of the strip into the receiving opening of the coiling drum, the master control device is connected to the controlled rotary drive of the coiling drum and to the displacement drive of the feeding shield and is configured to initiate the winding operation of the coiling drum and to commence displacement movement of the feeding shield from the threading position into the withdrawal position, wherein the passage for receiving the feeding shield is a passage through the enclosure of the coiling furnace different from the entry and exit opening in the enclosure for the hot-rolled metal strip.

2. The coiling furnace as claimed in claim 1, wherein in the threading position, the feeding shield is positioned at a distance from the winding surface of the coiling drum and directly next to the slit-shaped receiving opening.

3. The coiling furnace as claimed in claim 2, wherein the slit-shaped receiving opening on the coiling drum has a slit width which is less than four times the maximum thickness of the hot-rolled strip to be wound.

4. The coiling furnace as claimed in claim 2, wherein the slit-shaped receiving opening on the coiling drum has a slit width less than or equal to 80 mm.

5. The coiling furnace as claimed in claim 1, wherein the strip deflecting device and the feeding shield forming the feeding funnel have between them an opening angle of between 10° and 50° .

6. The coiling furnace as claimed in claim 1, wherein in the withdrawal position the feeding shield is positioned outside a maximum coil diameter and the shield is sized relative to the passage that the shield closes the passage in the enclosure.

7. The coiling furnace as claimed in claim 1, wherein the displacement drive of the feeding shield comprises a pressure-medium cylinder and a transmission mechanism between the displacement drive and the feeding shield with a minimum transmission ratio of up to 1:10.

8. The coiling furnace as claimed in claim 7, wherein the transmission mechanism comprises a lever system.

9. The coiling furnace as claimed in claim 8, wherein the lever system comprises a two-armed lever.

10. The coiling furnace as claimed in claim 1, wherein the controlled rotary drive is outside the furnace interior.

11. The coiling furnace as claimed in claim 10, further comprising a coiling shaft operable for a driving connection between the rotary drive and the coiling drum.

12. The coiling furnace as claimed in claim 1, wherein the displacement drive is outside the furnace interior.

13. The coiling furnace as claimed in claim 1, wherein the table for the strip is a roller table.

14. The coiling furnace as claimed in claim 1, wherein the strip deflecting device and the feeding shield forming the funnel have between them an opening angle of between 10° and 30°.

* * * * *

UNITED STATES PATENT AND TRADEMARK OFFICE

CERTIFICATE OF CORRECTION

PATENT NO. : 8,256,256 B2
APPLICATION NO. : 12/443738
DATED : September 4, 2012
INVENTOR(S) : Michael Jesche and Wolfgang Peitl It is certified that error appears in the above-identified patent and that said Letters Patent is hereby corrected as shown below:

On the Title Page

Item (75) First Inventor should read:

Michael Jesche

Signed and Sealed this
Twenty-seventh Day of November, 2012

David J. Kappos

David J. Kappos
*Director of the United States Patent and Trademark Office*